US008621754B2

(12) United States Patent
Adachi

(10) Patent No.: US 8,621,754 B2
(45) Date of Patent: Jan. 7, 2014

(54) HAIRDRESSING SCISSORS

(75) Inventor: Hidemi Adachi, Gifu (JP)

(73) Assignee: Adachi Industry Co., Ltd, Gifu (JP)

( * ) Notice: Subject to any disclaimer, the term of this patent is extended or adjusted under 35 U.S.C. 154(b) by 544 days.

(21) Appl. No.: 12/272,859

(22) Filed: Nov. 18, 2008

(65) Prior Publication Data

US 2009/0144989 A1 Jun. 11, 2009

Related U.S. Application Data

(63) Continuation of application No. PCT/JP2007/058906, filed on Apr. 25, 2007.

(30) Foreign Application Priority Data

May 19, 2006 (WO) ..... PCT/JP2006/310011

(51) Int. Cl.
*B26B 13/00* (2006.01)

(52) U.S. Cl.
USPC ..... 30/194; 30/254; 30/211

(58) Field of Classification Search
USPC ..... 30/254, 260, 349, 194, 270, 266, 340, 30/341, 344, 223, 211; 403/409.1, 367, 403/374.1; 81/416, 300
See application file for complete search history.

(56) References Cited

U.S. PATENT DOCUMENTS

| | | | | | |
|---|---|---|---|---|---|
| 331,934 | A * | 12/1885 | Aiken | 83/694 |
| 879,064 | A * | 2/1908 | Prohaska | 30/260 |
| 1,181,871 | A * | 5/1916 | Graham | 30/349 |
| 1,620,225 | A * | 3/1927 | Parker | 30/349 |
| 1,620,226 | A * | 3/1927 | Parker | 30/349 |
| 1,623,130 | A * | 4/1927 | Otis | 30/349 |
| 1,956,587 | A * | 5/1934 | Parker et al. | 30/349 |
| 2,369,271 | A * | 2/1945 | Arnold | 30/260 |
| 2,758,372 | A * | 8/1956 | Gammons | 30/260 |
| 2,939,213 | A * | 6/1960 | Daniel | 30/260 |
| 5,086,563 | A * | 2/1992 | Sakuma et al. | 30/260 |
| 2004/0057787 | A1* | 3/2004 | Cleveland | 403/374.1 |
| 2004/0159194 | A1* | 8/2004 | Ting | 81/416 |

FOREIGN PATENT DOCUMENTS

| | | |
|---|---|---|
| JP | 4-14048 U | 2/1992 |
| JP | 6-52767 U | 7/1994 |

* cited by examiner

*Primary Examiner* — Omar Flores Sanchez
(74) *Attorney, Agent, or Firm* — Dwayne L. Bentley; Hiroe & Associates

(57) ABSTRACT

The invention provides a pair of hairdressing scissors having a joint structure for joining a blade body of the hairdressing scissors. The joint structure enables a blade member and a finger ring member constituting the blade body to be easily assembled and separated from each other. The joint structure provides satisfactorily stable, firm and accurate joint performance and excellent design features. A blade member is formed with an engagement concave portion as an open plane in the base portion thereof and a finger ring member is formed with an engagement-protruding piece in the base portion thereof. When they are engaged and brought into close contact with each other, the engagement-protruding piece and the engagement concave portion are positioned and oriented properly as viewed in a width direction thereof. Thus, the blade member and the finger ring member can be stably assembled in a separable manner.

6 Claims, 20 Drawing Sheets

HAIRDRESSING SCISSORS

CROSS REFERENCE TO RELATED APPLICATION

This application is a continuation application of International Application No. PCT/JP2007/058906, filed on Apr. 25, 2007, the disclosure of which is incorporated herein by reference. International Application No. PCT/JP2007/058906 claims priority to International Application No. PCT/JP2006/310011 filed on May 19, 2006, priority to which is also claimed herein and the disclosure of which is also incorporated herein by reference.

FIELD OF THE INVENTION

The present invention relates to, but not limited to, a pair of hairdressing scissors, in particular a pair of hairdressing scissors characterized in a joint structure between a blade member and a finger ring member of a blade body constituting the pair of hairdressing scissors.

DESCRIPTION OF THE RELATED ART

A pair of hairdressing scissors is constituted of two blade bodies coupled with each other in a pivotal manner. As shown in FIG. 40, a blade body is constituted of a blade member 11 and a finger ring member 12 as a semi-finished product 10. Both blade member 11 and the finger ring member 12 are made of materials such as metal and/or ceramic, which provide functional features required for the respective component members. After being separately manufactured by means of forging, casting or the like, both member 11 and the finger ring member 12 are joined to each other. The surface is polished and the blade is sharpened to be completed into a finished product.

As joint means to join the blade member and the finger ring member to each other, conventionally, in addition to welding, tacking, screw cramping and the like, are known (For reference, Please note Japanese Unexamined Utility Model Publication Nos. 4-14048 and 6-53767). However, generally welding is employed in view of aspects of stability, accuracy, strength and design features of the joint (For reference, Please note International Publication No. 02/326431).

Hairdressing scissors have many kinds including hair cutting scissors having straight blades, carding scissors with a blade of which is formed in a comb-like shape. Also, the blade portion and the finger ring portion have a variety of shapes to accommodate the preferences of hairdressers/beauticians as the users.

Therefore, in order to provide hairdressing scissors that respond to various needs of hairdressers/beauticians as the customers; makers of hairdressing scissors, blade members and finger ring members having various shapes and configurations are previously prepared in a state of semi-finished products. After receiving an order from a customer, a blade member and a finger ring member are selected corresponding to the order; and welded to join each other. After being subjected to various processes, a pair of hairdressing scissors is completed into a finished product and delivered to the customer.

However, to produce a finished product, a considerably long time is required for carrying out processes such as welding, polishing and the like. As a result, the customer has to wait for a considerably long time from the order to the delivery of the pair of hairdressing scissors.

On the other hand, as a user of a pair of hairdressing scissors, hairdressers/beauticians want to always use his/her own hairdressing scissors that have been used for a long time and that fit to his/her hand.

In spite of the above-mentioned situation, for example, when cutting performance of a pair of hairdressing scissors becomes poor, a hairdresser/beautician has to place an order for sharpening the hairdressing scissors with the maker. Even when the blade members only have to be sharpened, since being joined with each other by means of welding, the blade members and the finger ring members cannot be separated. As a result, the pair of hairdressing scissors has to be handed over to the maker. Therefore, hairdressers/beauticians have to prepare spare hairdressing scissors to use the spare hairdressing scissors until the sharpening is completed.

Furthermore, some hairdressers/beauticians want to have a pair of hairdressing scissors where the uniqueness of the hairdressing scissors is enhanced by designs or arrangement of jewels, etc on the finger ring portions and/or blade portions of a pair of hairdressing scissors. However, when the blade member and the finger ring member cannot be separated from each other, for example, in the case where, it is impossible to recover the cutting performance even after sharpening, the entire pair of hairdressing scissors has to be replaced with a new one. In such a case, when a pair of decorated hairdressing scissors is replaced with a new one, the new hairdressing scissors has to be worked in order to be decorated the same again. The request of a user, who wants to have a pair of hairdressing scissors where the uniqueness of the hairdressing scissors is enhanced, fails to be satisfied.

SUMMARY OF THE INVENTION

To solve the above-described problems, it is necessary to employ a method other than welding, in which a blade member and a finger ring member can be joined to each other easily and firmly as well as, after being joined each other, the blade member and the finger ring member can be separated from each other. That is, by employing a joint method other than welding, it is possible for a maker thereof to previously carry out various processes such as sharpening on blade members and finger ring members. And receiving an order from a customer, the maker has to only join blade members and finger ring members to each other. Thus, the time from receiving order to delivery thereof can be reduced and the manufacturing cost is therefore reduced.

On the other hand, when ordering with the maker for, for example, maintenance or repairs such as sharpening, it is possible for a hairdresser/beautician to disassemble the blade member and the finger ring member to separate from each other, and to hand over only a component member that requires maintenance and/or repairs from to the maker. Therefore, it is possible for the hairdresser/beautician to attach a spare component member to the remaining component member and continue using of the pair of hairdressing scissors.

However, conventional joint methods other than welding are largely inferior to welding in stability, strength, accuracy and design features of the joint portion as described above. Therefore, they are hardly employed for actual use.

Accordingly, an embodiment of the present invention may, solve the problems mentioned above, and may provide a pair of hairdressing scissors having a joint structure of a blade body constituting the pair of hairdressing scissors with which a blade member and a finger ring member can be easily joined to each other, and even after being joined each other, the both can be separated from each other, and provide satisfactory joint stability, joint strength, joint accuracy and excellent design features.

In accordance with embodiment, there is provided a pair of hairdressing scissors 10, which comprises: a pair of blade bodies 100,100, each of the blade bodies 100,100 including a blade member 200 and a finger ring member 300 being joined to each other, two blade bodies 100,100 being coupled in a pivotal manner, wherein the blade member 200 has an engagement concave portion 220 formed as an open plane in a base portion 200A thereof, the finger ring member 300 has an engagement-protruding piece 330 that protrudes from a base portion 300A thereof being arranged so as to engage with the engagement concave portion 220, the engagement concave portion 220 is formed with a pair of first vertical-direction tapered portions 221, 221 each inclined in a longitudinal direction of the blade member 200, the engagement-protruding piece 330 is formed with a pair of second vertical-direction tapered portions 331, 331 each corresponding to the pair of first vertical-direction tapered portions 221, 221, the pair of hairdressing scissors 10 is arranged so that, when the engagement concave portion 220 and the engagement-protruding piece 330 are brought into close contact with each other, the pair of first vertical-direction tapered portions 221, 221 and the pair of second vertical-direction tapered portions 331, 331 slide on each other in a direction that the blade member 200 and the finger ring member 300 come into close contact with each other.

The pair of hairdressing scissors 10 is arranged so that the blade member 200 and the finger ring member 300 are joined to each other by, basically, engaging the engagement concave portion 220 formed on the blade member 200 and the engagement-protruding piece 330 formed on the finger ring member 300. However, unless the portions relevant to the joint are formed with extremely high accuracy, the engagement concave portion 220 and the engagement-protruding piece 330 are hardly joined to each other in a close contact state by means of a simple engagement. As a result, poor fitting or misalignment may result in poor stability of the joint. However, since not only a high degree of skill is required for forming the joint portion with such high accuracy but also, a considerably large cost and long time are required, mass production of the pair of hairdressing scissors 10 is extremely difficult.

Therefore, the embodiment of the present invention employs an engagement joint structure, and in order to ensure satisfactory joint stability and strength by a close contact between the engagement concave portion 220 and the engagement-protruding piece 330, the engagement concave portion 220 is formed with the pair of first vertical-direction tapered portions 221, 221 therein and the engagement-protruding piece 330 is formed with the pair of second vertical-direction tapered portions 331, 331 each corresponding to the since first vertical-direction tapered portions 221, 221.

That is, when the engagement concave portion 220 and the engagement-protruding piece 330 are engaged with each other, the pair of first vertical-direction tapered portions 221, 221 and the pair of second vertical-direction tapered portions 331, 331 come into contact with each other. When the engagement concave portion 220 and the engagement-protruding piece 330 are brought into further close contact with each other, the pair of first vertical-direction tapered portions 221, 221 and the pair of second vertical-direction tapered portions 331, 331 slide on each other. With this, a force that causes the engagement concave portion 220 and the engagement-protruding piece 330 to come closer to each other in a longitudinal direction (a direction indicated with arrows "I" and "I" in FIG. 22); and thereby the both are brought into close contact with each other.

In accordance with at least an embodiment, there is provided a pair of hairdressing scissors 10, which comprises: a pair of blade bodies 100,100, each of the blade bodies 100, 100 including a blade member 200 and a finger ring member 300 being joined to each other, two blade bodies 100,100 being coupled in a pivotal manner, wherein the blade member 200 has an engagement concave portion 220 formed as an open plane in a base portion 200A thereof, the finger ring member 300 has an engagement-protruding piece 330 that protrudes from a base portion 300A thereof being arranged so as to engage with the engagement concave portion 220, the engagement concave portion 220 is formed with a pair of first width-direction tapered portions 222, 222 each inclined in a width direction thereof, the engagement-protruding piece 330 is formed with a pair of second width-direction tapered portions 332, 332 each corresponding to the pair of first width-direction tapered portions 222, 222, the pair of hairdressing scissors 10 is arranged so that, when the engagement concave portion 220 and the engagement-protruding piece 330 are brought into close contact with each other, the pair of first width-direction tapered portions 222, 222 and the pair of second width-direction tapered portions 332, 332 slide on each other, thereby the engagement concave portion 220 and the engagement-protruding piece 330 are positioned and oriented properly as viewed in the width direction thereof.

The engagement concave portion 220 is formed with the pair of first width-direction tapered portions 222, 222; and the engagement-protruding piece 330 is formed with the pair of second width-direction tapered portions 332, 332. With this arrangement, the engagement-protruding piece 330 is prevented from moving in the engagement concave portion 220 in the width direction (the direction indicated with arrows "J", "J" in FIG. 26). At the time, the engagement-protruding piece 330 is positioned to be parallel with respect to the engagement concave portion 220; thus a stable joint state is ensured.

To describe in more detail, when the engagement-protruding piece 330 is engaged with the engagement concave portion 220, the pair of first width-direction tapered portions 222, 222 and the pair of second width-direction tapered portions 332, 332 come into contact with each other. When the engagement concave portion 220 and the engagement-protruding piece 330 are brought into further close contact with each other, the pair of first width-direction tapered portions 222, 222 and the pair of second width-direction tapered portions 332, 332 slide on each other. And the engagement-protruding piece 330 is imparted with a force to move the same toward the center of the engagement concave portion 220 from the both sides thereof as viewed in the width direction. As a result, the engagement-protruding piece 330 is prevented from moving in the width direction and fixed at the center position of the engagement concave portion 220, and at the same time, the engagement-protruding piece 330 is disposed to be parallel with respect to the engagement concave portion 220.

As described above, by disposing the pair of first width-direction tapered portions 222, 222 and the pair of second width-direction tapered portions 332, 332, the engagement concave portion 220 and the engagement-protruding piece 330 are fixed at a predetermined position as viewed in the width direction.

In accordance with at least an embodiment, there is a pair of hairdressing scissors 10, which comprises: a pair of blade bodies 100,100, each of the blade bodies 100,100 including a blade member 200 and a finger ring member 300 being joined to each other, two blade bodies 100,100 being coupled in a pivotal manner, wherein the blade member 200 has an engagement concave portion 220 formed as an open plane in a base portion 200A thereof, the finger ring member 300 has an engagement-protruding piece 330 that protrudes from a base portion 300A thereof being arranged so as to engage with the engagement concave portion 220, the engagement concave portion 220 is formed with a pair of first vertical-direction tapered portions 221, 221 each inclined in a longitudinal direction of the blade member and a pair of first width-direction tapered portions 222, 222 each inclined in a width direction thereof, the engagement-protruding piece 330 is formed with a pair of second vertical-direction tapered portions 331, 331 each corresponding to the pair of first vertical-direction tapered portions 221, 221 and a pair of second width-direction tapered portions 332, 332 each corresponding to the pair of first width-direction tapered portions 222, 222, the pair of hairdressing scissors 10 is arranged so that, when the engagement concave portion 220 and the engagement-protruding piece 330 are brought into close contact with each other, the pair of first vertical-direction tapered portions 221, 221 and the pair of second vertical-direction tapered portions 331, 331 slide on each other in a direction that the blade member 200 and the finger ring member 300 are brought into close contact with each other, at the same time the pair of first width-direction tapered portions 222, 222 and the pair of second width-direction tapered portions 332, 332 slide on each other, thereby the engagement concave portion 220 and the engagement-protruding piece 330 are positioned and oriented properly as viewed in the width direction thereof.

The pair of hairdressing scissors 10 set forth in the third aspect of the embodiment has the structures set forth in the first aspect and the second aspect in combination thereof. That is, in the engagement concave portion 220 formed in the blade member 200, the pair of first vertical-direction tapered portions 221, 221 and the pair of first width-direction tapered portions 222, 222 are formed. And in the engagement-protruding piece 330 formed in the finger ring member 300, the pair of second vertical-direction tapered portions 331, 331 and the pair of second width-direction tapered portions 332, 332 are formed. With this arrangement, the blade member 200 and the finger ring member 300 can be joined to each other in a close contact state as well as fixed at a predetermined position as viewed in the width direction. Thus, the blade member 200 and the finger ring member 300 are joined to each other so as to be separated from each other, at the same time the joint stability is ensured more reliably.

The pair of hairdressing scissors according to the embodiment includes not only the one used for cutting human hair but also the one used for cutting hair of animals. In the specification, the wording "join/joint" means to integrate the blade member (engagement concave portion) and the finger ring member (engagement-protruding piece) in a separable manner.

In accordance with at least an embodiment, there is the pair of hairdressing scissors 10 set forth in the first to third aspects of the invention, wherein the engagement concave portion 220 and the engagement-protruding piece 330 are brought into close contact with each other by means of a screw 400 screwed into screw holes 223, 333 formed in the engagement concave portion 220 and the engagement-protruding piece 330 respectively.

The engagement concave portion 220 and the engagement-protruding piece 330 are brought into close contact with each other by means of the screw. With this arrangement, the engagement concave portion 220 and the engagement-protruding piece 330 are held in a close contact state. At the same time, the blade member 200 and the finger ring member 300 can be easily separated from each other and joined to each other any time.

A solution employed in the fifth aspect of the embodiment is the pair of hairdressing scissors 10 set forth in the first to fourth aspects of the embodiment, wherein, a pair of protruding portions 340, 340 is formed on an end face of the base portion 200A of the blade member 200 or in the vicinity of the base portion of the engagement-protruding piece 330 formed on the finger ring member 300, and on the counterpart thereof, a pair of insertion portions 230, 230 is formed for allowing the pair of protruding portions 340, 340 to be inserted thereinto.

With the pair of protruding portions 340, 340 formed at the both sides of the engagement-protruding piece 330, which are inserted into the pair of insertion portions 230, 230 formed in the end face of the engagement concave portion 220, the joint portion is prevented from twisting. That is, by inserting the pair of protruding portions 340, 340 into the pair of insertion portions 230, 230, in addition to the above-described prevention of movement in a longitudinal direction by the pair of first vertical-direction tapered portions 221, 221 and the pair of second Vertical-direction tapered portions 331, 331 and prevention of movement in the width direction by the pair of first width-direction tapered portions 222, 222 and the pair of second width-direction tapered portions 332, 332, the joint portion is secured from three dimensional directions.

Furthermore, the pair of protruding portions 340, 340 abuts on the inner surfaces of the pair of insertion portions 230, 230. The abutting portions function as fulcrum when the engagement concave portion 220 and the engagement-protruding piece 330 are brought into close contact with each other; thereby the engagement concave portion 220 and the engagement-protruding piece 330 are brought into close contact with each other more firmly.

A solution employed in the sixth aspect of the embodiment is the pair of hairdressing scissors set forth in any one of the first to fifth aspects, wherein a contact point 240 is formed on the pair of blade members 200, 200 only.

The wording "contact point" means a portion having a circular shape round the hole through which a bolt is inserted and functions as a fulcrum axle of the a pair of opening/closing blade bodies. When cutting something with the pair of hairdressing scissors, due to cutting resistance, the rear faces of the pair of blade bodies tends to separate away from each other. However, at the same time, a cutting resistance large enough to reduce the smoothness of opening/closing operation of the pair of blade bodies is applied to the contact point.

When a force larger than the cutting resistance is applied to the pair of hairdressing scissors, due to the applied force, the contact points slide on each other in a close contact state. Thus, the pair of blade bodies opens and closes to cut the object in a close contact state without separating from each other.

As described above, the contact point largely affects in the cutting performance of the pair of hairdressing scissors. According to the invention set forth in the sixth aspect, the contact point is formed on the pair of blade members 200, 200 only. That is, since the contact point 240 is formed on the pair of blade members 200, 200 only, when either the pair of blade members 200, 200 or the pair finger ring members 300 is replaced with a new one, the function of the contact point is not reduced.

According to the first aspect of the embodiment, in the pair of hairdressing scissors, each of the blade members is formed with the engagement concave portion having the pair of first vertical-direction tapered portions, the finger ring member is formed with engagement-protruding piece having the pair of second vertical-direction tapered portions each corresponding to the pair of first vertical-direction tapered portion. When the blade member and the finger ring member are engaged and brought into close contact with each other, the pair of first vertical-direction tapered portions and the pair of second vertical-direction tapered portions slide on each other. Thus, the blade member and the finger ring member are brought into close contact with each other and joined with each other. With this arrangement, superior joint stability can be ensured while allowing the blade member and the finger ring member to be separated from each other.

According to the second aspect of the embodiment, in the pair of hairdressing scissors, each of the blade members is formed with the engagement concave portion having the pair of first width-direction tapered portions and the finger ring member is formed with the engagement-protruding piece having the pair of second width-direction tapered portions each corresponding to the pair of first width-direction tapered portions. When the blade member and the finger ring member are engaged and brought into close contact with each other, the pair of first width-direction tapered portions and the pair of second width-direction tapered portions are slide on each other and the engagement-protruding piece is prevented from moving in the width direction thereof in the engagement concave portion; thereby the blade member and the finger ring member are positioned and joined with each other. With this arrangement, superior joint stability can be ensured while allowing the blade member and the finger ring member to be separated from each other.

According to the third aspect of the embodiment, in the pair of hairdressing scissors, the blade members is formed with engagement concave portion having the pair of first vertical-direction tapered portions and the pair of first width-direction tapered portions, while the finger ring member is formed with the engagement-protruding piece having the pair of second vertical-direction tapered portions each corresponding to the pair of first vertical-direction tapered portions and the pair of second width-direction tapered portions each corresponding to the pair of first width-direction tapered portions. When the blade members and the engagement-protruding piece are engaged and brought into close contact with each other, satisfactory joint stability can be ensured while allowing the blade member and the finger ring member to be separated from each other. That is, when the engagement concave portion and the engagement-protruding piece are brought into close contact with each other, the pair of first vertical-direction tapered portions and the pair of second vertical-direction tapered portions slide on each other; thereby the joint end of the blade member and the joint end of the finger ring member can be brought into close contact and joined with each other. At the same time, the pair of first width-direction tapered portions and the pair of second width-direction tapered portions slide on each other; thereby the engagement-protruding piece is prevented from moving in the width direction and positioned properly in the engagement concave portion.

Moreover, as a common effect provided by the pair of hairdressing scissors according to claims 1-3, since joining the blade member and the finger ring member so as to be separated, for example, even when the surface of the finger ring member is decorated with a design with a laser beam radiation or by arranging jewels and/or ornament articles such as beads, by replacing the blade member only with a new one, the finger ring member can be repeatedly used. Therefore, the user can obtain an original pair of hairdressing scissors.

According to the fourth aspect of the embodiment, in addition to the effect of the pair of the hairdressing scissors set forth in any one of the first to third aspects, in the pair of hairdressing scissors, the engagement concave portion and the engagement-protruding piece are held in a close contact state by means of the screw screwed into the screw holes formed in the engagement concave portion and the engagement protruding portion. Thereby, both of the engagement concave portion and the engagement-protruding piece are firmly held in the close contact state while the blade member and the finger ring member are allowed to be separated from each other anytime and joined with each other.

According to the fifth aspect of the embodiment, in addition to the effect of the pair of hairdressing scissors set forth in any one of the first to fourth aspects, in the pair of hairdressing scissors, the protruding portions are formed on the end face of the blade member or in the vicinity of the base of the engagement-protruding piece formed on the finger ring member; and on the other part thereof, the insertion portions, into which the protruding portions are inserted, are formed. With this arrangement, the joint portions are prevented from moving in a twisting direction or separating away from each other in a vertical direction.

According to the sixth aspect of the embodiment, in addition to the effect of the pair of hairdressing scissors set forth in any one of the first to fifth aspects, in the pair of hairdressing scissors, the contact point is formed on the blade members only. Therefore, even when either one of the pair of blade members or the pair of finger ring members is replaced with another one, since the position of the contact point is unchanged, stable cutting performance is always ensured. Also, the contact state between the contact points can be adjusted on the blade members only. Therefore, for example, in order for maintenance such as sharpening by the maker, when the pair of blade members are disassembled and handed over the maker, it is possible for the maker to adjust the contact point and to return the same to the customer. Moreover, conventionally, the contact point has to be formed after welding the respective blade members and finger ring members. On the other hand, since the contact point can be formed on the blade members only before joining the blade member and the finger ring member. Accordingly, the manufacturing process can be simplified.

BRIEF DESCRIPTION OF THE DRAWINGS

Embodiment will now be described, by way of example only, with reference to the accompanying drawings which are meant to be exemplary, not limiting, and wherein like elements are numbered alike in several Figures, in which.

EXPLANATION OF REFERENCE NUMERALS

Figure 1:
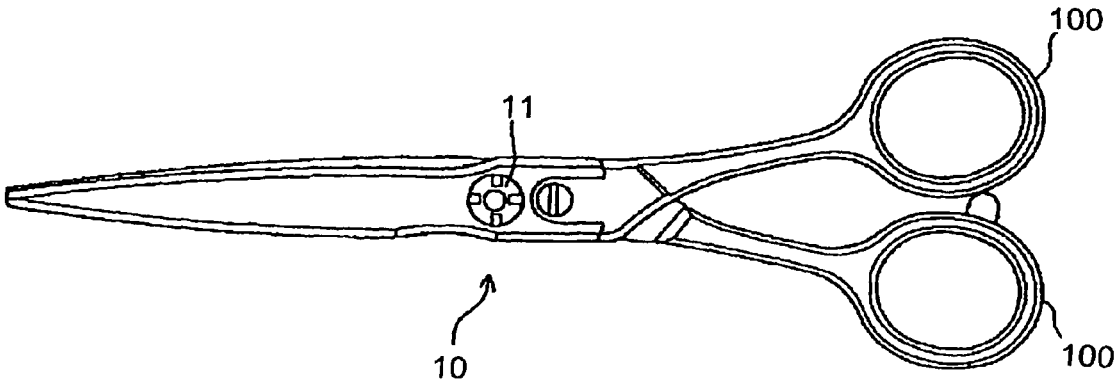
FIG. 1 is a plane view of a pair of hairdressing scissors according to embodiment 1.

10: a pair of hairdressing scissors
100: blade body
200: blade member
220: engagement concave portion
221: first vertical-direction tapered portion
222: first width-direction tapered portion
223: screw hole
230: insertion portion
300: finger ring member
330: engagement-protruding piece
331: second vertical-direction tapered portion
332: second width-direction tapered portion
333: screw hole
340: protruding portion
400: screw

DETAILED DESCRIPTION OF REFERENCED EMBODIMENT

[Embodiment 1]

Figure 2:
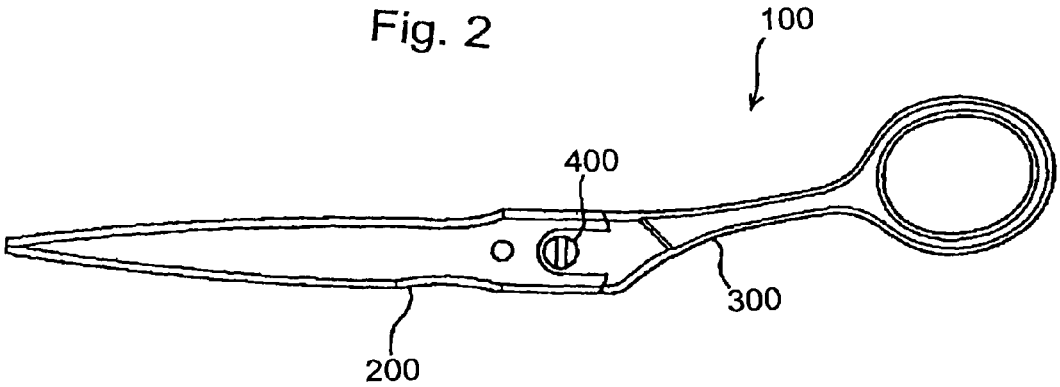
FIG. 2 is a plane view of a blade body constituting the pair of hairdressing scissors according to embodiment 1.
Figure 3:
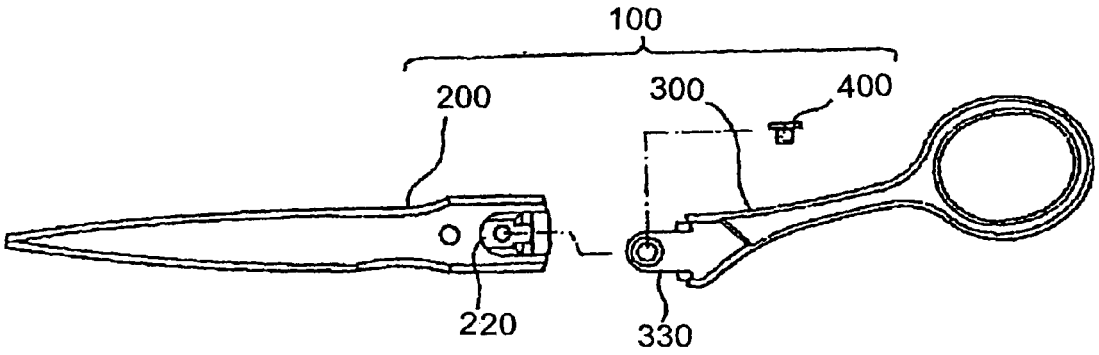
FIG. 3 is an exploded plane view of the blade body constituting the pair of hairdressing scissors according to embodiment 1.
Figure 4:
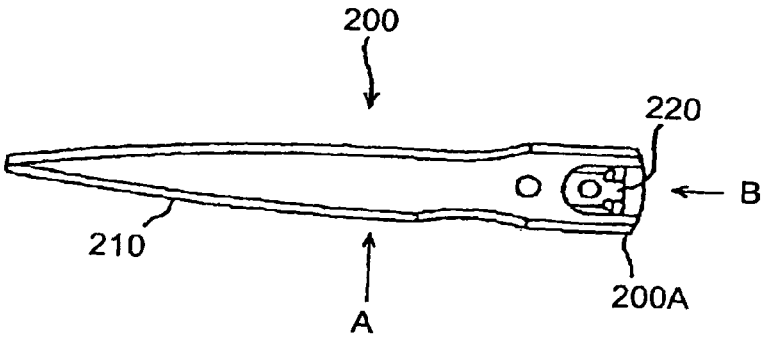
FIG. 4 is a plane view of a blade member constituting the blade body according to embodiment 1.
Figure 5:
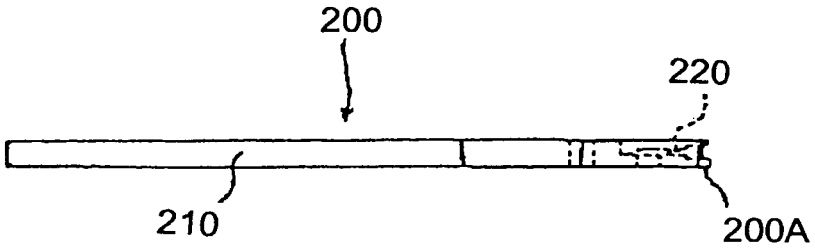
FIG. 5 illustrates the blade member according to embodiment 1 as viewed in a direction indicated with an arrow "A" in FIG. 4.
Figure 6:
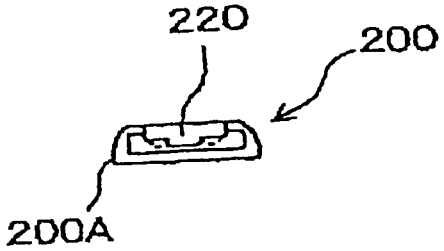
FIG. 6 illustrates the blade member according to embodiment 1 as viewed in a direction indicated with an arrow "B" in FIG. 4.

FIG. 1 illustrates a pair of hairdressing scissors 10 according to embodiment 1. The pair of hairdressing scissors 10. Two blade bodies 100 and 100 are attached to each other in a pivotal manner with a bolt 11. Two blade bodies 100 and 100 are arranged so as to open/close on the bolt 11 as the fulcrum. FIG. 2 and FIG. 3 illustrate one of the blade bodies 100 and 100 constituting the hairdressing scissors 10. As illustrated in FIG. 2 and FIG. 3, the blade body 100 is constituted of a blade member 200 and a finger ring member 300 being joined with each other.

FIG. 4 to FIG. 7 illustrate the blade member 200 constituting the blade body 100. The blade member 200 includes a blade portion 210 formed with a blade and an engagement concave portion 220 located in a base portion 200A arranged to join with the finger ring member 300.

Figure 7:
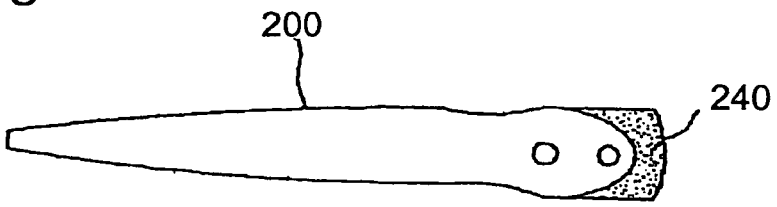
FIG. 7 is a bottom plane view of the blade member according to embodiment 1.

The blade member 200 is formed with a contact point 240 on the rear face thereof as shown in FIG. 7. The contact point 240 is not formed on the finger ring member 300 but is formed on the blade member 200 only.

Figure 8:
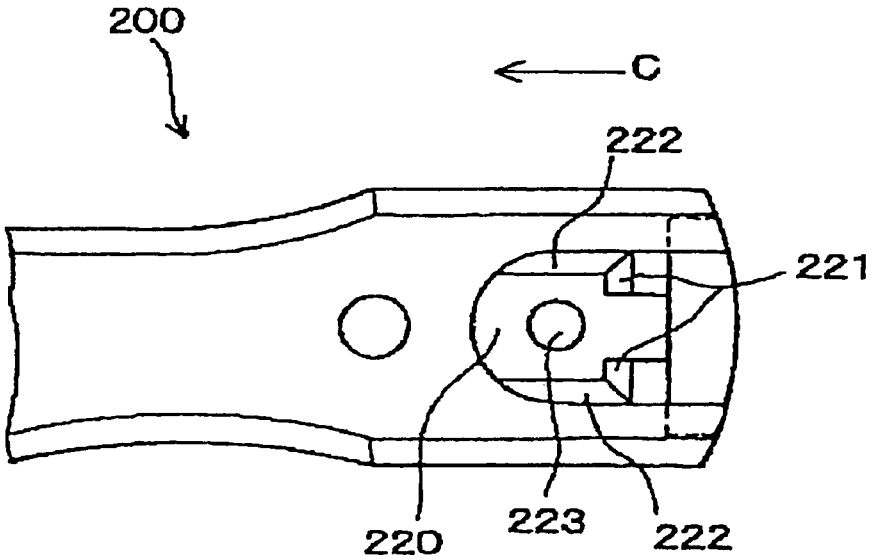
FIG. 8 is an enlarged plane view of an engagement concave portion formed on the blade member according to embodiment 1.
Figure 9:
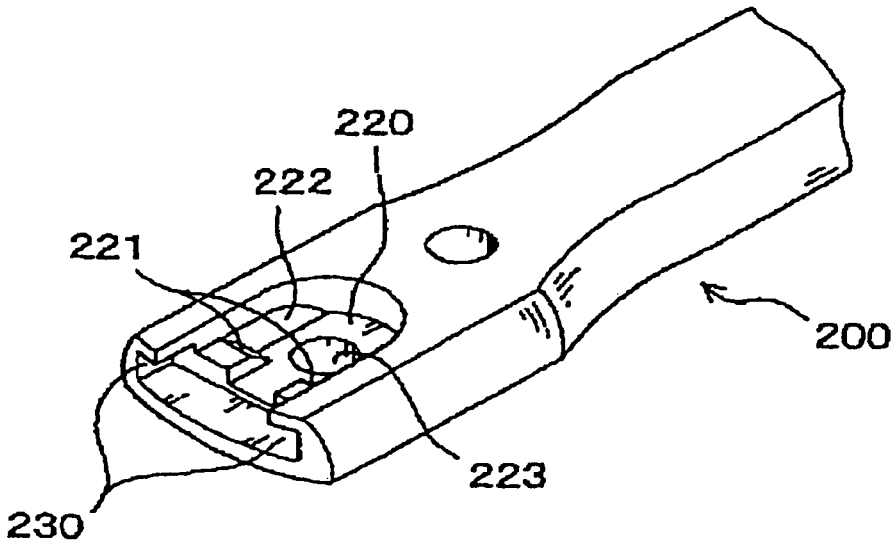
FIG. 9 is an enlarged perspective view of the engagement concave portion formed on the blade member according to embodiment 1.
Figure 10:
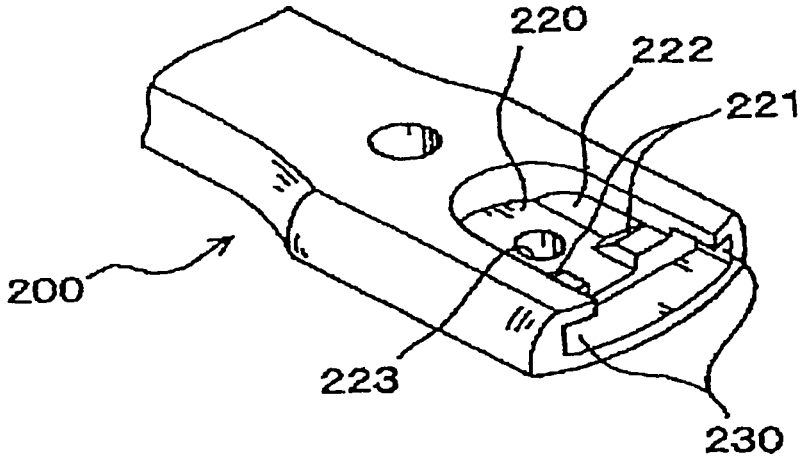
FIG. 10 is an enlarged perspective view of the engagement concave portion formed on the blade member according to embodiment 1.

FIG. 8 to FIG. 10 illustrate an enlarged engagement concave portion 220 on the blade member 200. The engagement concave portion 220 is formed with a plane that is opened as illustrated in FIG. 8 to FIG. 10. The engagement concave portion 220 includes a pair of first vertical-direction tapered portions 221, 221, a pair of first width-direction tapered portions 222, 222 and a screw hole 223 through which a screw 400 is screwed thereinto. Each of the first vertical-direction tapered portions 221, 221 is inclined downward from the base portion of the blade member 200 toward the front end thereof (a direction indicated with an arrow "C" in FIG. 8). Each of the first width-direction tapered portions 222, 222 is inclined downward in a width-direction of the engagement concave portion 220. Each of the first vertical-direction tapered portions 221, 221 and each of the first width-direction tapered portions 222, 222 perpendicularly intersect each other along the inclination directions thereof.

Furthermore, the blade member 200 is formed with a pair of insertion portions 230, 230 in the end face of the base portion 200A into which a pair of protruding portions 340, 340 formed on the finger ring member 300 are inserted.

Figure 11:
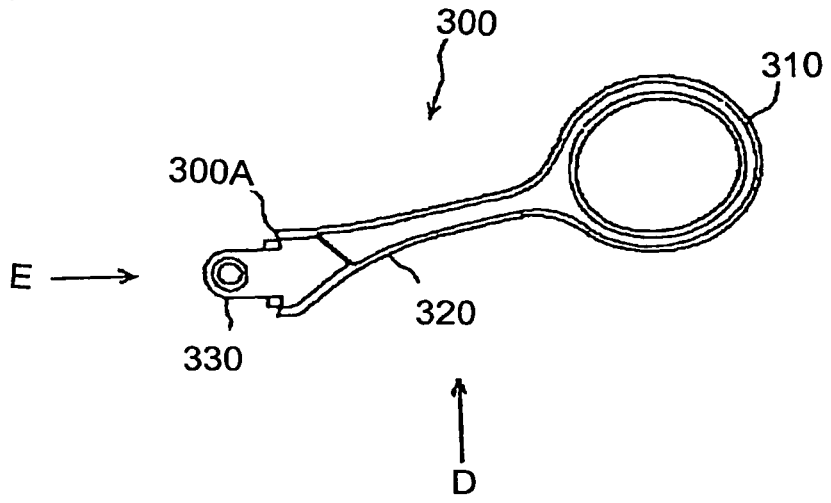
FIG. 11 is a plane view of a finger ring member constituting the blade body according to embodiment 1.
Figure 12:
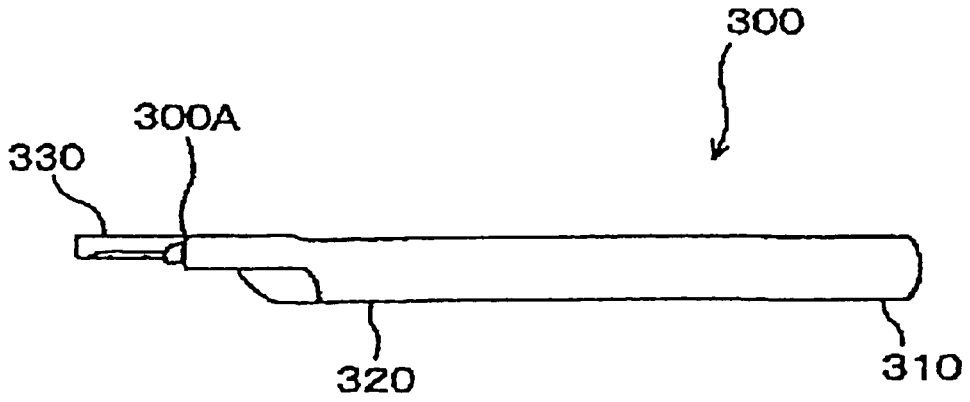
FIG. 12 illustrates a finger ring member according to embodiment 1 as viewed from a direction indicated with an arrow "D" in FIG. 11.
Figure 13:
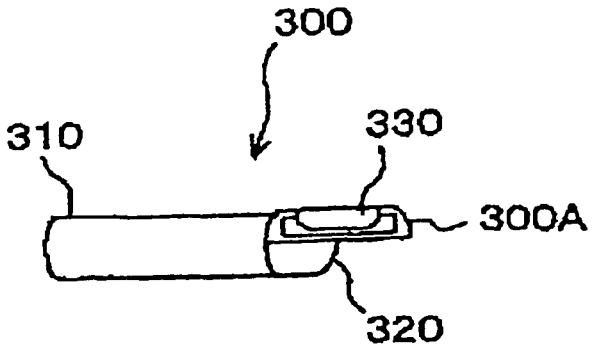
FIG. 13 illustrates a finger ring member according to embodiment 1 as viewed from a direction indicated with an arrow "E" in FIG. 11.

FIG. 11 to FIG. 13 illustrate a finger ring member 300 constituting the blade body 100. The finger ring member 300 is constituted of a finger ring portion 310 and a shaft portion 320. Formed being protruding from a base portion 300A of the shaft portion 320 is an engagement-protruding piece 330 that engages with the engagement concave portion 220 formed on the blade member 200.

Figure 14:
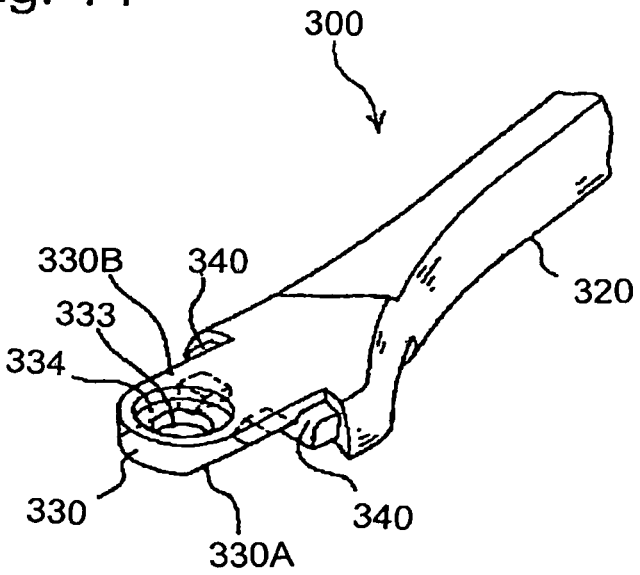
FIG. 14 is an enlarged perspective view of an engagement-protruding piece formed on the finger ring member according to embodiment 1.
Figure 15:
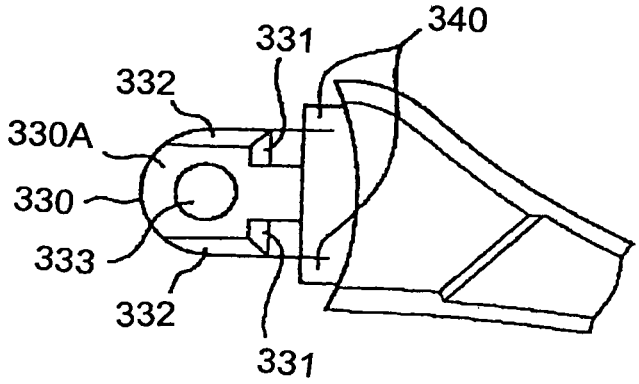
FIG. 15 is an enlarged bottom plane view of the engagement-protruding piece formed on the finger ring members according to embodiment 1.
Figure 16:
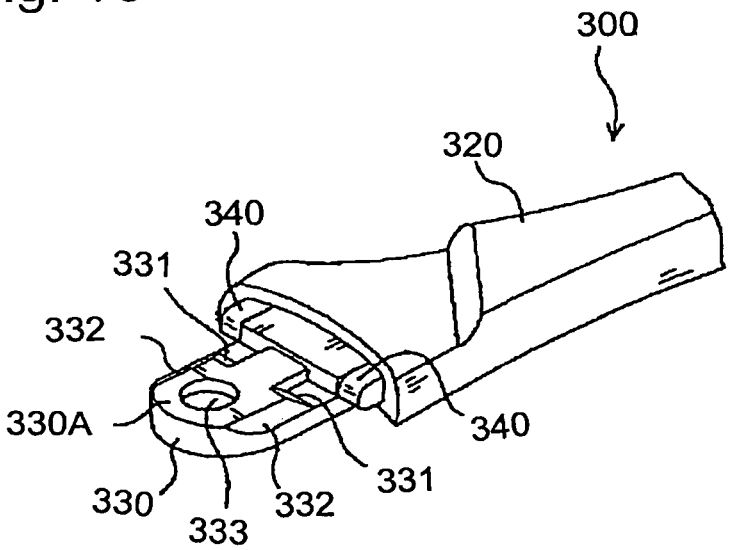
FIG. 16 is an enlarged perspective view of the engagement-protruding piece formed on the finger ring member according to embodiment 1 as viewed from the bottom.

FIG. 14 to FIG. 16 are enlarged views of the engagement-protruding piece 330. As shown in FIG. 14 to FIG. 16, the engagement-protruding piece 330 is formed with a pair of second vertical-direction tapered portions 331, 331 and a pair of second width-direction tapered portions 332, 332 and a screw hole 333 on the rear face 330A of the engagement-protruding piece 330. Each of the second vertical-direction tapered portions 331, 331 are formed being inclined downward from the front end of the engagement-protruding piece 330 toward the base portion thereof. With this arrangement, when the engagement-protruding piece 330 is engaged with the engagement concave portion 220 formed in the blade member 200, each of the second vertical-direction tapered portions 331, 331 fit with each of the first vertical-direction tapered portions 221, 221 formed in the engagement concave portion 220.

Each of the second width-direction tapered portions 332, 332 is formed at the outer side of each of the second vertical-direction tapered portions 331, 331. Each of the second width-direction tapered portions 332, 332 is formed being inclined downward toward the outer side of the engagement-protruding piece 330 so that, when the engagement-protruding piece 330 is engaged with the engagement concave portion 220, each of the second width-direction tapered portions 332, 332 fits with each of the first width-direction tapered portions 222, 222.

The screw hole 333 is formed to fix the engagement concave portion 220 and the engagement-protruding piece 330 to each other with the screw 400 that is screwed thereinto. Furthermore, the engagement-protruding piece 330 is formed with a counter cavity 334 for receiving a head of the screw 400 in the front side 330B thereof. At the both sides of the engagement-protruding piece 330, a pair of protruding portions 340, 340 extends from the base portion 300A of the shaft portion 320. The pair of protruding portions 340, 340 is inserted into the pair of insertion portions 230, 230 formed in the blade member 200.

As describe above, the engagement concave portion 220 formed in the blade member 200 and the engagement-protruding piece 330 formed on the finger ring member 300 are engaged with each other; thereby the blade member 200 and the finger ring member 300 are joined with each other.

Figure 17:
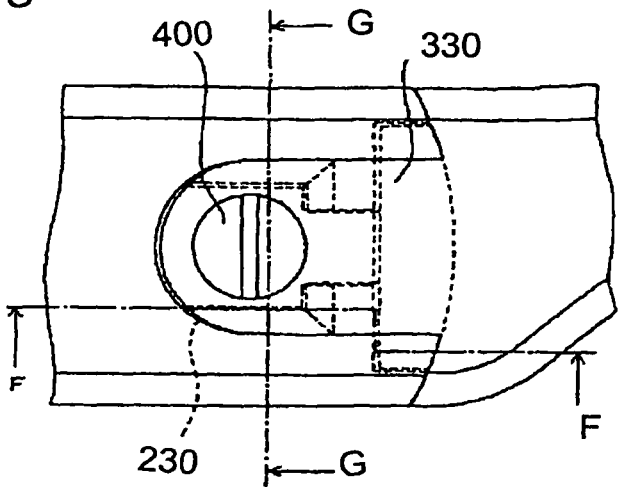
FIG. 17 is a plane view illustrating the engagement concave portion and the engagement-protruding piece engaged with each other according to embodiment 1.
Figure 18:
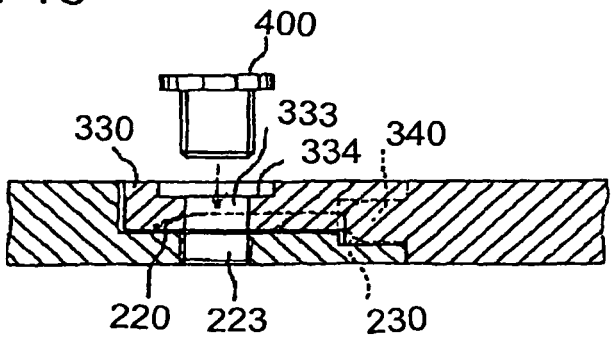
FIG. 18 is a sectional view along a line F-F in FIG. 17.

FIG. 17 and FIG. 18 illustrate a state that the engagement concave portion 220 and the engagement-protruding piece 330 are engaged with each other. As shown in FIG. 17 and FIG. 18, the engagement-protruding piece 330 is engaged with the engagement concave portion 220 in a state that the engagement-protruding piece 330 is received entirely by the engagement concave portion 220; and both are secured by the screw 400.

Now, assembly process that the blade member 200 and the finger ring member 300 are joined to each other will be described. FIG. 19 to FIG. 23 illustrate the process that the engagement concave portion 220 and the engagement-protruding piece 330 are engaged with each other. FIG. 20 to FIG. 23 show a sectional view of the joint portion along a line F-F in FIG. 17.

Here, the operation of the first vertical-direction tapered portions 221, 221, which are formed on the engagement concave portion 220, and the second vertical-direction tapered portions 331, 331, which are formed on the engagement-protruding piece 330, will be described in detail.

Figure 19:
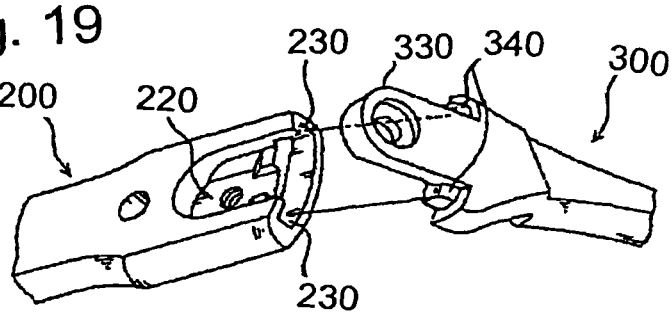
FIG. 19 illustrates a method to insert the protruding portion into the insertion portion in accordance with embodiment 1.
Figure 20:
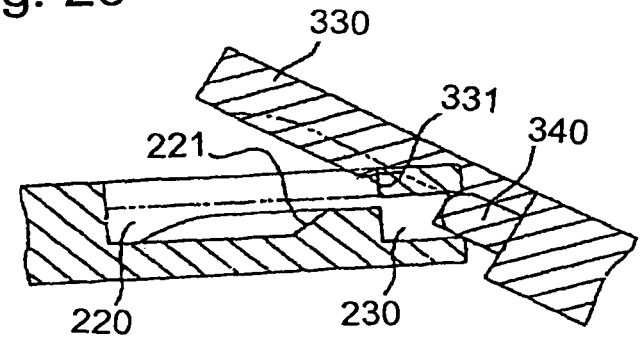
FIG. 20 is a sectional view along the line F-F in FIG. 17, which illustrates the engagement process of the engagement concave portion and the engagement-protruding piece.

First of all, the finger ring member 300 and the blade member 200 are hold being opposed to each other at an angle with respect to each other as shown in FIG. 19 and FIG. 20. From this state, the protruding portions 340, 340, which are formed on the finger ring member 300 are inserted into the insertion portions 230, 230, which are formed in the blade member 200.

Figure 21:
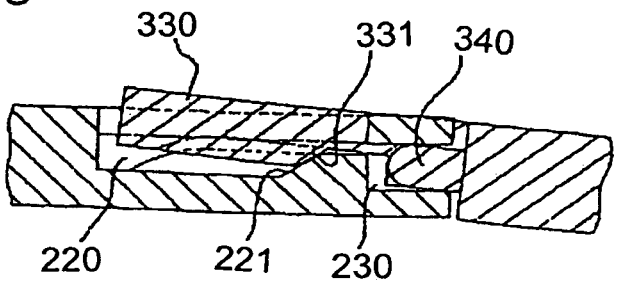
FIG. 21 is a sectional view along the line F-F in FIG. 17, which illustrates the engagement process of the engagement concave portion and the engagement-protruding piece.

Then, while maintaining a state that the protruding portions 340, 340 are inserted into the insertion portions 230, 230 as shown in FIG. 21, the engagement-protruding piece 330 is engaged with the engagement concave portion 220. At this time, the pair of the second vertical-direction tapered portions 331, 331 formed on the engagement-protruding piece 330 comes into contact with the pair of the first vertical-direction tapered portions 221, 221 formed on the engagement concave portion 220.

Figure 22:
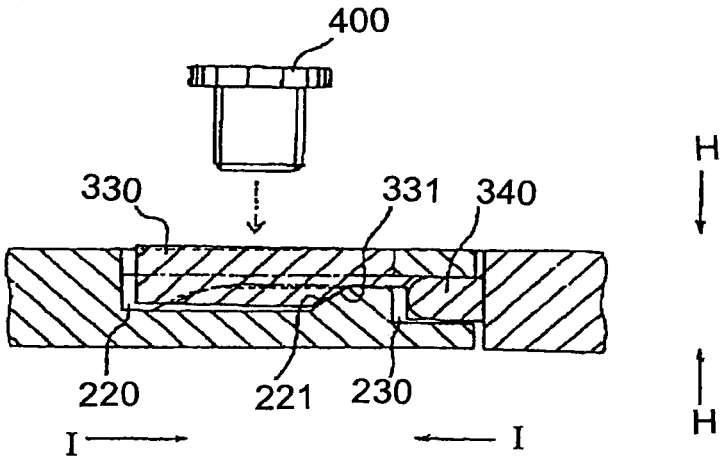
FIG. 22 is a sectional view along the line F-F in FIG. 17, which illustrates the engagement process of the engagement concave portion and the engagement-protruding piece.
Figure 23:
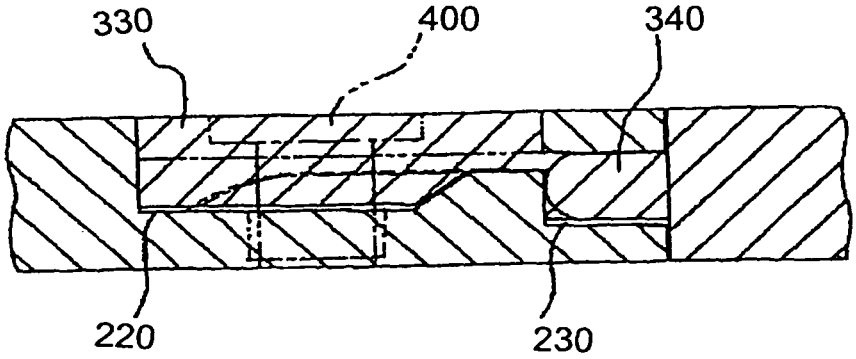
FIG. 23 is a sectional view along the line F-F in FIG. 17, which illustrates the engagement process of the engagement concave portion and the engagement-protruding piece.

Subsequently, the engagement-protruding piece 330 is made to be closer to the engagement concave portion 220 to be received therein as shown in FIG. 22 and the screw 400 is screwed into the screw holes. On contact points between inside portions of the insertion portions 230, 230 and the protruding portions 340, 340 as a fulcrum, the engagement concave portion 220 and the engagement-protruding piece 330 are pressed on each other in a vertical direction (directions indicated with arrows "H", "H" in FIG. 22). At the same time, the pair of second vertical-direction tapered portions 331, 331 comes into contact with the pair of first vertical-direction tapered portions 221, 221 and slides thereon. With this, between the engagement concave portion 220 and the engagement-protruding piece 330, a force works on the both to pull each other in a longitudinal direction (a direction indicated with arrows "I", "I" in FIG. 22). As a result, the end face of the blade member 200 and the end face of the finger ring member 300 are caused to come into closed contact with each other as shown in FIG. 23.

That is, as the engagement concave portion 200 and the engagement-protruding piece 330 are forcibly caused to contact with each other, the close contact between the end face of the blade member 200 and the end face of the finger ring member 300 is further increased.

Here, even after the engagement concave portion 220 and the engagement-protruding piece 330 are brought into a complete contact, to prevent the bottom of the engagement-protruding piece 330 from coming into contact with the bottom of the engagement concave portion 220, the engagement concave portion 220 is formed so that the depth thereof is larger than the thickness of the engagement-protruding piece 330 to ensure a clearance between the engagement concave portion 220 and the engagement-protruding piece 330. With this arrangement, when the engagement-protruding piece 330 and the engagement concave portion 220 are strongly tightened, the engagement-protruding piece 330 may be further proceeded into the engagement concave portion 220 resulting in a step between the surface of the blade member 200 and the surface of the finger ring member 300. However, even when such a step is generated, since the step is extremely small, no adverse affect is given to the design features of the blade body.

Thus, with the pair of first vertical-direction tapered portions 221, 221 and the pair of the second vertical-direction tapered portions 331, 331, the blade member 200 and the surface of the finger ring member 300 are fixed not to move in a longitudinal direction as well as in a vertical direction by tightening the screw 400. Furthermore, with the pair of insertion portions 230, 230 and the pair of protruding portions 340, 340 twisting movement and separation in the vertical direction are prevented.

Figure 24:
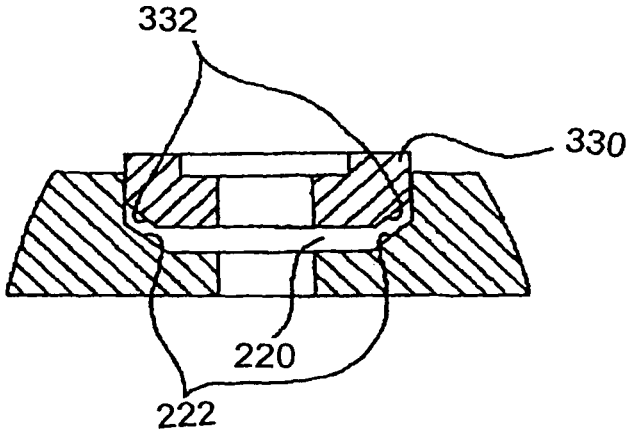
FIG. 24 is a sectional view along the line G-G in FIG. 17, which illustrates the engagement process of the engagement concave portion and the engagement-protruding piece.
Figure 25:
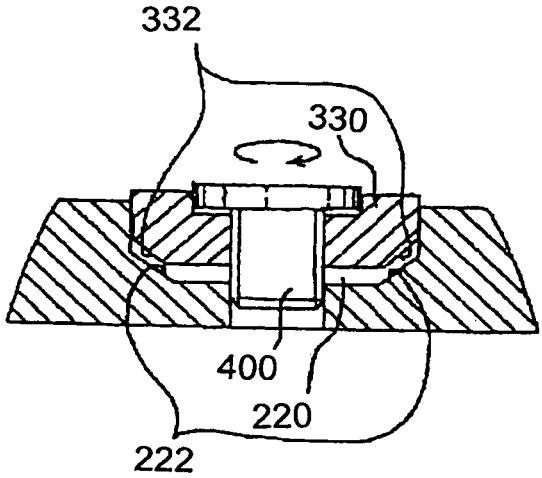
FIG. 25 is a sectional view along the line G-G in FIG. 17, which illustrates the engagement process of the engagement concave portion and the engagement-protruding piece.
Figure 26:
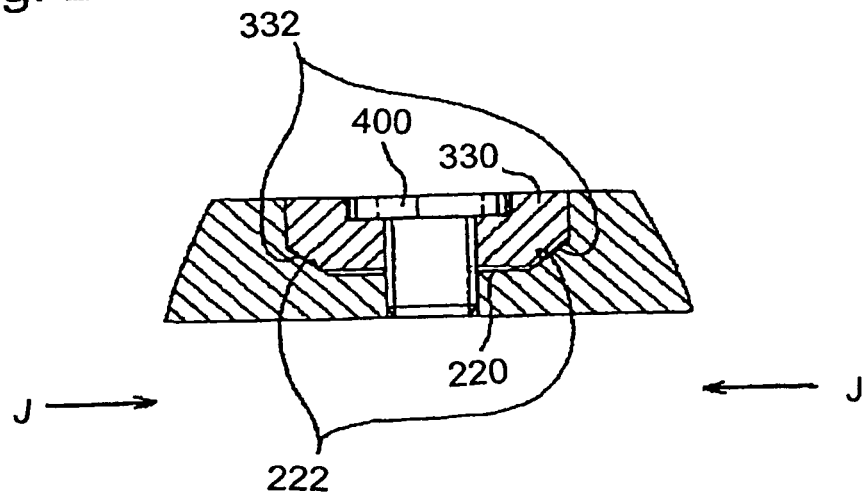
FIG. 26 is a sectional view along the line G-G in FIG. 17, which illustrates the engagement process of the engagement concave portion and the engagement-protruding piece.
Figure 27:
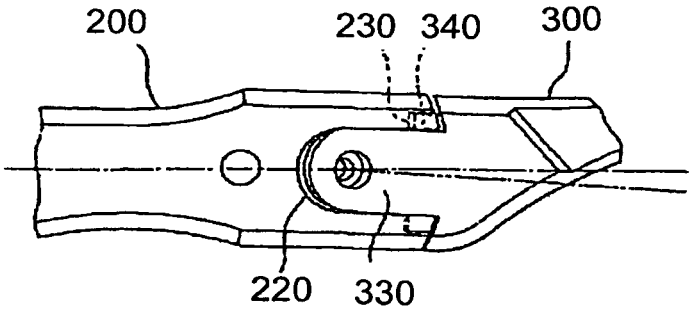
FIG. 27 is a plane view illustrating the engagement process of the engagement concave portion and the engagement-protruding piece according to embodiment 1.
Figure 28:
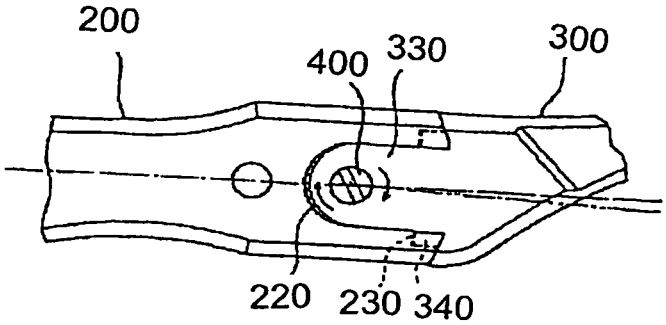
FIG. 28 is a plane view illustrating the engagement process of the engagement concave portion and the engagement-protruding piece according to embodiment 1.
Figure 29:
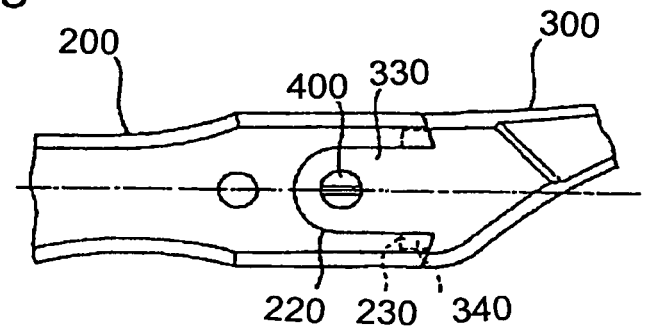
FIG. 29 is a plane view illustrating the engagement process of the engagement concave portion and the engagement-protruding piece according to embodiment 1.

Now, the operation of the first width-direction tapered portions 222, 222 formed in the engagement concave portion 220 and the second width-direction tapered portions 332, 332 formed in the engagement-protruding piece 330 will be described below. FIGS. 24-29 illustrate a state that the engagement-protruding piece 330 is engaged with the engagement concave portion 220. FIGS. 24-26 illustrate a sectional view as viewed along a line G-G in FIG. 17. FIGS. 27-29 illustrate a state as viewed from the top.

First of all, the engagement-protruding piece 330 is engaged with the engagement concave portion 220 as shown in FIG. 24 and FIG. 27. At this time, the engagement concave portion 220 and the engagement-protruding piece 330 are overlapped with each other at a small angle with respect to each other.

Subsequently, when the screw 400 is screwed into the screw holes as shown in FIG. 25 and FIG. 28, the engagement concave portion 220 and the engagement-protruding piece 330 are brought into close contact with each other, and the pair of first width-direction tapered portions 222, 222 and the pair of second width-direction tapered portions 332, 332 slide on each other. Here, accompanying this sliding movement, two forces act on the engagement-protruding piece 330 from the both sides thereof as viewed in the width direction (directions indicated with arrows "J" and "J" in FIG. 26). With this, the engagement-protruding piece 330 is forced to move toward the center of the engagement concave portion 220. Thus, the engagement-protruding piece 330 is positioned at the center of the engagement concave portion 220, and the engagement concave portion 220 and the engagement-protruding piece 330 are oriented properly so as to be parallel to each other.

When the sliding movement of the pair of first width-direction tapered portions 222, 222 and the pair of second width-direction tapered portions 332, 332 is completed, the forces acting on the engagement-protruding piece 330 from the both sides as viewed in the width direction get balanced as shown in FIG. 26 and FIG. 29. Thus, the engagement-protruding piece 330 is fixed to a predetermined position in the engagement concave portion 220 as viewed in the width direction, and the engagement-protruding piece 330 is oriented properly so as to align with engagement concave portion 220.

As described above, when the engagement concave portion 220 formed on the blade member 200 and the engagement-protruding piece 330 formed on the finger ring member 300 are engaged with each other, the blade member 200 and the finger ring member 300 are firmly joined to each other.

That is, the engagement concave portion 220 and the engagement-protruding piece 330 are secured in a vertical direction by fastening the screw 400. At the same time, the engagement concave portion 220 and the engagement-protruding piece 330 are secured in a longitudinal direction with the sliding movement of the pair of first vertical-direction tapered portions 221, 221 and the pair of second vertical-direction tapered portions 331, 331. Further, the engagement concave portion 220 and the engagement-protruding piece 330 are positioned in the width direction and oriented properly with the pair of first width-direction tapered portions 222, 222 and the pair of second width-direction tapered portions 332, 332.

Furthermore, with the pair of insertion portions 230, 230 and the pair of protruding portions 340, 340, the movement in a twisting direction is eliminated. Thus, the blade member 200 and the finger ring member 300 are completely secured in three-dimensional directions.

On the other hand, the blade member 200 and the finger ring member 300 can be easily separated by unfastening the screw 400 that holds the engagement concave portion 220 and the engagement-protruding piece 330 in close contact with each other.

[Embodiment 2]

Figure 30:
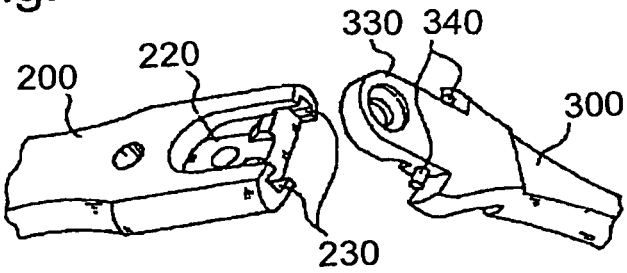
FIG. 30 illustrates a blade member and a finger ring member according to embodiment 2.

FIG. 30 illustrates the blade member 200 and the finger ring member 300 constituting the blade body 100 of the pair of hairdressing scissors according to embodiment 2. The basic structure in embodiment 2 is the same as that in embodiment 1. That is, the structure of the engagement concave portion 220 formed on the blade member 200 and the structure of the engagement-protruding piece 330 formed on the finger ring member 300 are the same. However, the structure of the pair of protruding portions 340, 340 and the pair of insertion portions 230, 230 are different from that in embodiment 1. That is, according to embodiment 1, the pair of protruding portions 340, 340 formed on the finger ring member 300 is extended from the base portion 300A of the finger ring member 300. On the other hand, according to embodiment 2, the pair of protruding portions 340, 340 are formed in a pin-like shape that protruding from the both sides of the engagement-protruding piece 330 as shown in FIG. 30. The pair of protruding portions 340, 340 formed in a pin-like shape provides the same function and effect as those in embodiment 1.

[Embodiment 3]

Figure 31:
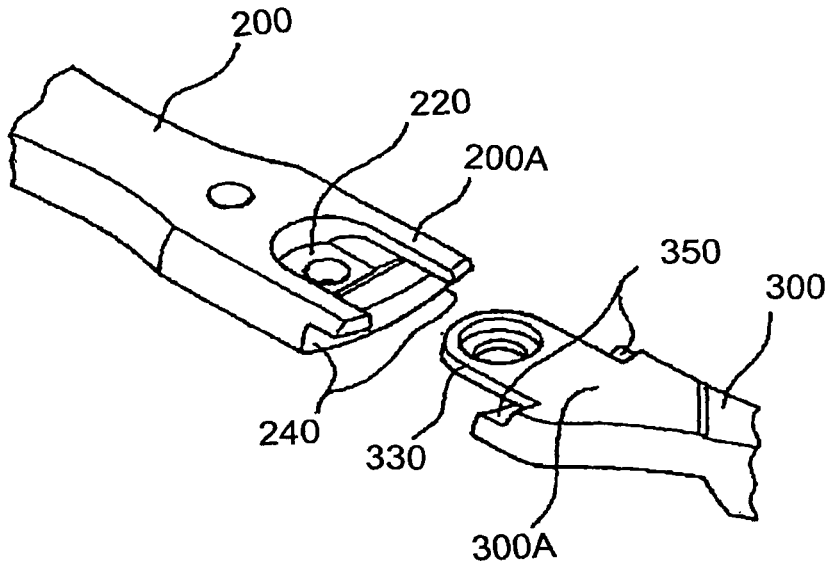
FIG. 31 illustrates a blade member and a finger ring member according to embodiment 3.

FIG. 31 illustrates the blade member 200 and the finger ring member 300 constituting the blade body 100 of the pair of hairdressing scissors according to embodiment 3. In embodiment 3 also, the basic structure is the same as that in embodiment 1. However, embodiment 3 is different from embodiment 1 in a point that the structure of the pair of protruding portions 340, 340 and the pair of insertion portions 230, 230 is simplified. Alternatively, in the base portions 200A and 300A of the blade member 200 and the finger ring member 300, a pair of cutout portions 240 and 350 is formed respectively from the end face to the plane thereof. With these pair of cutout portions 240 and 350 overlapped with each other, the blade member 200 and the finger ring member 300 are secured to prevent from twisting.

[Embodiment 4]

Figure 32:
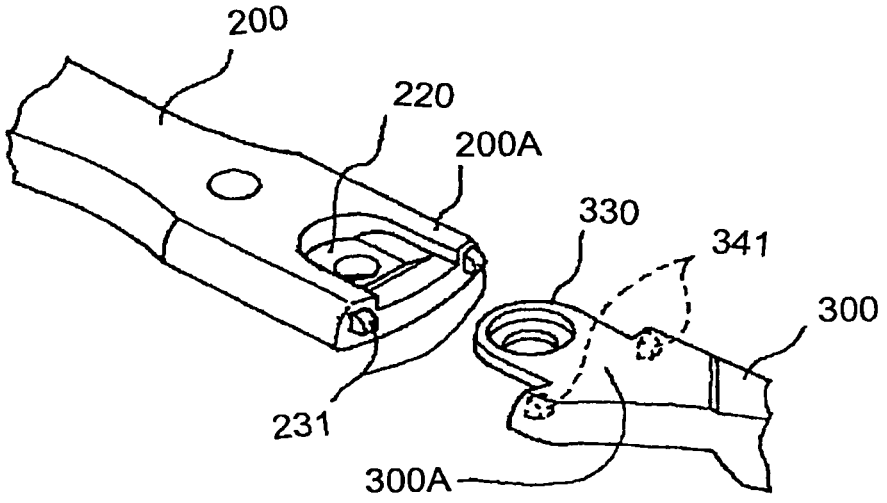
FIG. 32 illustrates a blade member and a finger ring member according to embodiment 4.

FIG. 32 illustrates the blade member 200 and the finger ring member 300 constituting the blade body 100 of the pair of hairdressing scissors according to embodiment 4. In embodiment 4 also, the basic structure is the same as that in embodiment 1. The pair of protruding portions 340, 340 and the pair of insertion portions 230, 230 are inversely disposed on the blade member 200 and the finger ring member 300. That is, the pair of protruding portions 231, 231 is formed in the end face of a base portion 200A of the blade member 200. While the pair of insertion portions 341, 341 is formed in the end face of a base portion 300A of the finger ring member 300 as shown in FIG. 32. As described above, the pair of protruding portions and the pair of insertion portions may be formed either by the blade member or the finger ring member respectively.

Embodiments 1 to 4 have been described above. The above-described embodiments may be variously modified within the range of the technical spirit of the invention. Such modifications should be included within the technical range of the invention.

Figure 33:
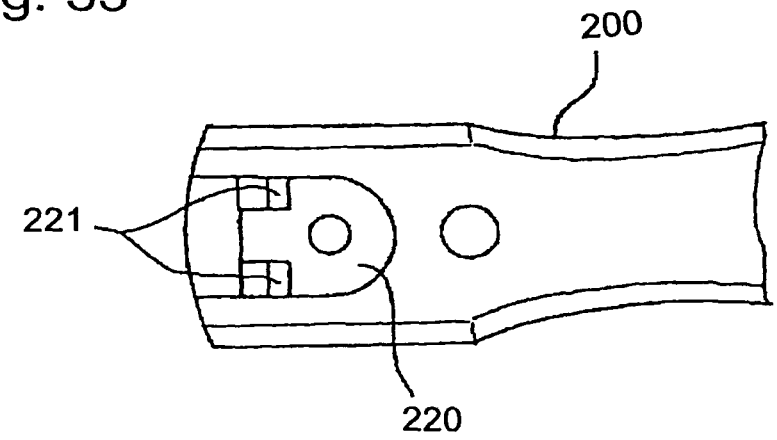
FIG. 33 is an enlarged plane view illustrating another embodiment of the engagement concave portion formed on the blade member.
Figure 34:
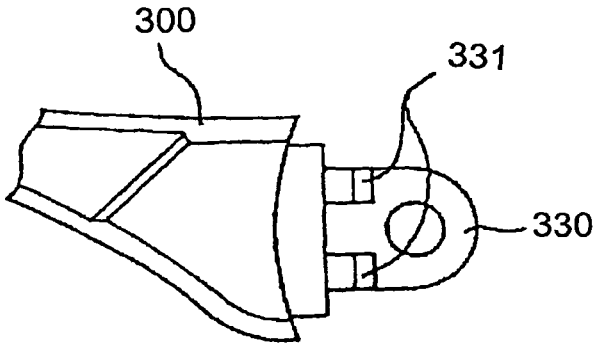
FIG. 34 is an enlarged plane view illustrating another embodiment of the engagement-protruding piece formed on the finger ring member.
Figure 35:
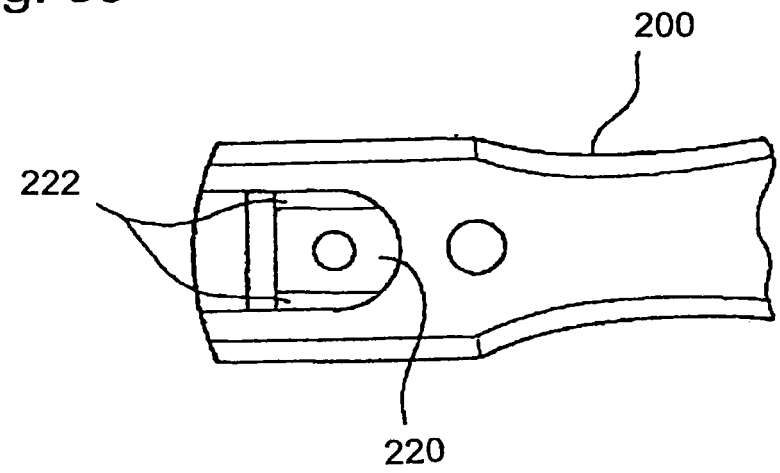
FIG. 35 is an enlarged plane view illustrating another embodiment of the engagement concave portion formed on the blade member.
Figure 36:
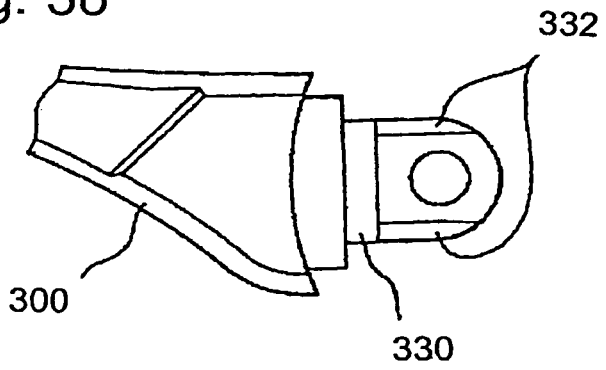
FIG. 36 is an enlarged plane view illustrating another embodiment of the engagement-protruding piece formed on the finger ring member.
Figure 37:
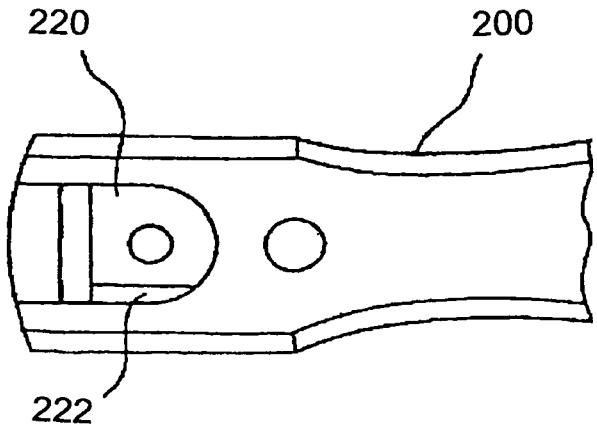
FIG. 37 is an enlarged plane view illustrating another embodiment of the engagement concave portion formed on the blade member.
Figure 38:
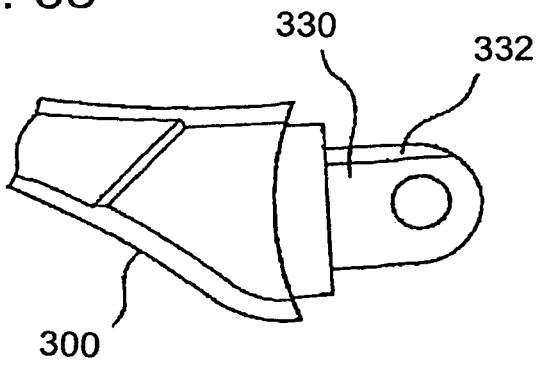
FIG. 38 is an enlarged plane view illustrating another embodiment of the engagement-protruding piece formed on the finger ring member.

For example, the engagement concave portion 220 and the engagement-protruding piece 330 may be formed with the pair of first vertical-direction tapered portions 221, 221 and the pair of second vertical-direction tapered portions 331, 331 only as shown in FIG. 33 and FIG. 34. The engagement concave portion 220 and the engagement-protruding piece 330 may be formed with the pair of first width-direction tapered portions 222, 222 and the pair of second width-direction tapered portions 332, 332 only as shown in FIG. 35 and FIG. 36. Furthermore, the engagement concave portion 220 and the engagement-protruding piece 330 may be formed with a first width-direction tapered portion 222 and a second width-direction tapered portion 332 at one side as shown in FIG. 37 and FIG. 38.

Figure 39:
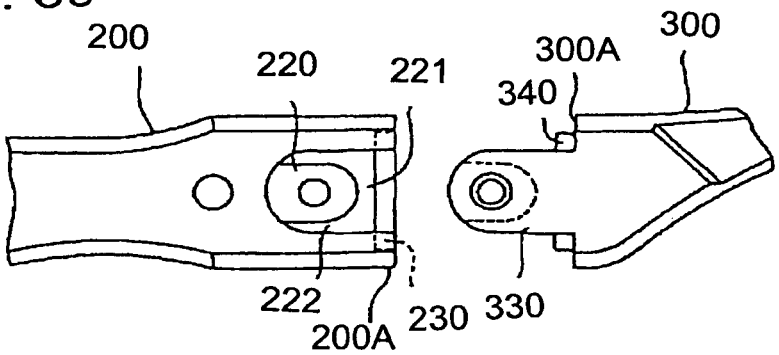
FIG. 39 is an enlarged plane view illustrating another embodiment of the engagement concave portion formed on the blade member and the engagement-protruding piece formed on the finger ring member.
Figure 40:
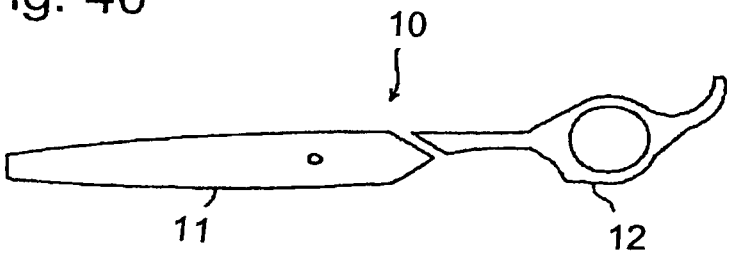
FIG. 40 illustrates a structure of a blade body of a pair of conventional hairdressing scissors.

Moreover, in the above-described embodiments, the pair of first vertical-direction tapered portions 221, 221 of the engagement concave portion 220 and the pair of first width-direction tapered portions 222, 222 formed on the blade member 200, the pair of second vertical-direction tapered portions 331, 331, the pair of second width-direction tapered portions 332, 332 of the engagement-protruding piece 330 formed on the finger ring member 300 are formed continuously so as to intersect perpendicularly to each other. However, the tapered portions may be formed continuously in a curved shape as shown in FIG. 39. Also, in the above-described embodiments, the end face of the base portion 200A of the blade member 200 and the end face of the base portion 300A of the finger ring member 300 are form in a curved face respectively. However, the end faces may be formed in a flat plane respectively as shown in FIG. 39.

The protruding portion formed on the finger ring member or the blade member does not always have to be molded integrally with the finger ring member or the blade member. The protruding portion may be manufactured as a separate component member and attached to the finger ring member or the blade member afterward.

While the description above refers to particular embodiment of the present invention, it will be understood that many modifications may be made departing from the spirit thereof.

The companying claims are intended to cover such modifications as would fall within the true scope and spirit of the present invention.

The presently described embodiments are therefore to be considered in all respects as illustrative and restrictive, the scope of the invention being indicated by the appended claims, rather than the foregoing description, and all changes which come within the meaning and range of equivalency of the claims are therefore intended to be embraced therein.

What is claimed is:

1. A pair of hairdressing scissors comprising:

a pair of blade bodies, each of the blade bodies including a blade member and a finger ring member being joined to each other, two blade bodies being coupled in a pivotal manner, wherein the blade member has an engagement concave portion formed as an open pane in a base portion thereof, the finger ring member has an engagement-protruding piece that protrudes from a base portion thereof being arranged so as to engage with the engagement concave portion, the engagement concave portion is formed with a pair of parallel first width-direction tapered portions each inclined from an outer edge toward the center of the engagement concave portion in a direction substantially parallel to the width direction thereof and extend length wise and in parallel in a direction substantially parallel to the blade members, the engagement-protruding piece is formed with a pair of parallel second width-direction tapered portions each corresponding to the pair of first width-direction tapered portions, wherein the pairs of first and second width-direction tapered portions extend only partially into the engagement concave portion and the engagement-protruding piece, respectively, the pair of hairdressing scissors is arranged so that, when the engagement concave portion and the engagement-protruding piece are brought into close contact with each other, the pair of first width-direction tapered portions and the pair of second width-direction tapered portions slide on each other, thereby the engagement concave portion and the engagement-protruding piece are positioned and oriented properly as viewed in the width direction thereof.

2. The pair of hairdressing scissors to claim 1, wherein the engagement concave portion and the engagement-protruding piece are brought into close contact with each other by means of a screw screwed into screw holes formed in the engagement concave portion and the engagement-protruding piece respectively.

3. The pair of hairdressing scissors according to claim 1, further comprising:

a contact point; and said contact point formed on the blade member only, wherein said contact point forms a fulcrum axle for scissor operation, and wherein said contact point remains substantially constant when the finger ring members or blade members are placed.

4. A pair of hairdressing scissors comprising:

a pair of blade bodies, each of the blade bodies including a blade member and a finger ring member being joined to each other, two blade bodies being coupled in a pivotal manner, wherein the blade member has an engagement concave portion formed as an open plane in a base portion thereof, the finger ring member has an engagement-protruding piece that protrudes from a base portion there being arranged so as to engage with the engagement concave portion, the engagement concave portion is formed with a pair of first vertical-direction tapered portions each inclined in a downward direction toward the blade member, on the engagement concave portion, substantially parallel to the longitudinal direction of the blade member and a pair of first width-direction tapered portions each inclined from an outer edge toward the center of the engagement concave portion in a direction substantially parallel to the width direction thereof, the engagement-protruding piece is formed with a pair of second vertical-direction tapered portions each corresponding to the pair of first vertical-direction tapered portions and a pair of second width-direction tapered portions each corresponding to the pair of first width direction tapered portions, wherein the pairs of first and second vertical-direction tapered portions extend only partially into the engagement concave portion and the engagementprotruding piece, respectively, and wherein the pairs of first and second width-direction tapered portions extend onto partially into the engagement concave portion and the engagement-protruding piece, respectively, the pair of hairdressing scissors is arranged so that, when the engagement concave portion and the engagement-protruding piece are brought into close contact with each other, the pair of first vertical-direction tapered portions and the pair of second vertical-direction tapered portions are slide on each other in a direction that the blade member and the finger ring member are brought into close contact with each other, at the same time the pair of first width-direction tapered portions and the pair of second width-direction tapered portion slide on each other, thereby the engagement concave portion and the engagement-protruding piece are positioned and oriented properly as viewed in the width direction thereof.

5. The pair of hairdressing scissors according to claim 4, wherein the engagement concave portion and the engagement-protruding piece are brought into close contact with each other by means of a screw screwed into screw holes formed in the engagement concave portion and the engagement-protruding piece respectively.

6. The pair of hairdressing scissors according to claim 4, further comprising:

a contact point; and said contact point formed on the blade member only, wherein said contact point forms a fulcrum axle for scissor operation, and wherein said contact point remains substantially constant when the finger ring members or blade members are replaced.

* * * * *